US005957226A

United States Patent [19]

Holte

[11] Patent Number: 5,957,226

[45] Date of Patent: Sep. 28, 1999

[54] REVERSE CIRCULATION DRILLING SYSTEM WITH HEXAGONAL PIPE COUPLING

[76] Inventor: Ardis L. Holte, 181 Polk St., Eugene, Oreg. 97402

[21] Appl. No.: 09/010,306

[22] Filed: Jan. 21, 1998

Related U.S. Application Data

[63] Continuation-in-part of application No. 08/790,066, Jan. 28, 1997.

[51] Int. Cl.[6] ..... F16L 35/00; E21B 43/00

[52] U.S. Cl. ..... 175/320; 285/330

[58] Field of Search ..... 285/305, 330, 285/317, 404; 175/320; 166/242.6

[56] References Cited

U.S. PATENT DOCUMENTS

| | | | |
|---|---|---|---|
| 3,786,878 | 1/1974 | Chapman | 175/320 |
| 4,655,482 | 4/1987 | Myers et al. | 285/305 |
| 4,811,975 | 3/1989 | Paul, Jr. et al. | 285/305 |
| 5,511,628 | 4/1996 | Holte | 175/296 |
| 5,882,044 | 3/1999 | Sloane | 285/330 |

*Primary Examiner*—William Neuder

*Attorney, Agent, or Firm*—Marger Johnson & McCollom, P.C.

[57] ABSTRACT

A reverse circulation, pneumatic drilling assembly wherein the bit assembly is operatively connected to a dual wall pipe assembly. A supply of compressed air is conducted through the annulus of the dual wall pipe assembly to a down hole pneumatic hammer. Exhaust air from the down hole hammer is directed to the bit assembly for continuous removal of drilling debris through a central evacuation tube of the dual wall pipe assembly. Sections of the dual wall pipe are joined by hex head couplings which are quickly and easily engaged and disengaged.

7 Claims, 16 Drawing Sheets

REVERSE CIRCULATION DRILLING SYSTEM WITH HEXAGONAL PIPE COUPLING

RELATED APPLICATION

This is a continuation-in-part application of U.S. Ser. No. 08/790,066, filed Jan. 28, 1997.

BACKGROUND OF THE INVENTION

The present invention is related to earth drilling equipment, and particularly to down hole, pneumatic, percussive hammer drilling systems. As noted in my related co-pending application, Ser. No. 08/674,123, filed Jul. 1, 1996, to which the present application is a continuation-in-part, underreamers are used for the formation of radially enlarged areas extending about a pilot bit for insertion of a casing.

Eccentrically mounted underreamers are known which include an arm which travels in an orbit for underreaming operation, and which are retractable toward the hole axis for tool removal purposes. However, eccentrically mounted underreamers can be diverted off-axis if the underreamer encounters rock fragments, buried metal objects, etc. Any diversion of a large drill bit is unacceptable in most drilling operations, and particularly where a series of closely spaced holes are being formed. The installation of casing in a drilled ground hole is also greatly hindered by any such diversion.

Other known underreaming equipment utilizes three bit mounted plates which are outwardly displaceable, bit which incorporate a total working surface which is substantially less than the perimeter of the bore. Such undersized plates are subject to excessive wear and result in slow drilling operation. Underreaming can also be achieved by use of a crown or ring bit, but components of those bits must be left in the underreamed area when drilling is complete, which is costly and otherwise unacceptable in some drilling operations.

Each of these problems is addressed by my co-pending U.S. application Ser. No. 08/674,123, and by the additional related underreamer embodiments disclosed and claimed below.

In addition to the foregoing problems associated with known underreamers, quick and efficient removal of drilling debris from the hole and drilling bits remains a problem. In my U.S. Pat. No. 5,511,628, which is hereby expressly incorporated by reference into this application, I disclosed a pneumatic down-hole drill with a central evacuation outlet. The apparatus of U.S. '628 permits continuous evacuation of large debris fragments through a central axial bore formed in the bit and through a central evacuation tube attached thereto. Compressed air is directed downwardly through peripheral channels, under the drill bit, and into a central evacuation tube. The flow of compressed air through the central evacuation tube provides continuous and efficient removal of earthen fragments from the bore, including rapid removal of fragments which would be too large for removal through peripheral pathways along the casing.

However, a need remains for a reverse circulation pneumatic drill which provides for underreaming of the bore, continuous evacuation of drilling debris fragments from the drilling face in the bore, and for ready removal of the drill bit through the casing during or after completion of the drilling operation.

SUMMARY OF THE INVENTION

The present invention is embodied in a reverse circulation system which addresses the shortcomings of the prior art.

It is therefore an object of the invention to provide an underreamer which includes a pilot bit on which are mounted underreamer arms which can be extended and retracted by relative rotation between the pilot bit and the underreamer arms. Each underreamer arm includes a strengthening boss. The strengthening boss includes axial bearing surfaces which engage corresponding axial surfaces of the pilot bit. The bearing surfaces of the arm bosses and the bits include surfaces shaped to extend the arms as the pilot bit is rotated relative to the pilot bit. Surfaces are also provided for locking the arm in its extended underreaming position. As the bit is rotated in the opposite direction, the locking surfaces disengage and the arm can be retracted without vertical movement of the driver.

In another aspect of the invention, the dual-wall pipe sections are each fitted with a male and female hex-head couplings. The hex-head couplings can be readily assembled and dissembled using only hand tools, avoiding the difficulties associated with threaded couplings. Threaded couplings, while generally suitable, can become jammed as a result of the torque transmitted through the dual wall pipe during drilling. Once jammed, dissembling the pipe sections can be quite difficult, often requiring the use of power equipment to separate them. The hex-head connector of the present invention avoids those problems by providing a dual-wall pipe assembly which can be readily assembled and disassembled, and which is not subject to jamming during operation of the drilling rig.

BRIEF DESCRIPTION OF THE DRAWINGS

FIG. 6A is an exploded perspective view of a second embodiment of a bit assembly according to the present invention.

DETAILED DESCRIPTION

Figure 1:
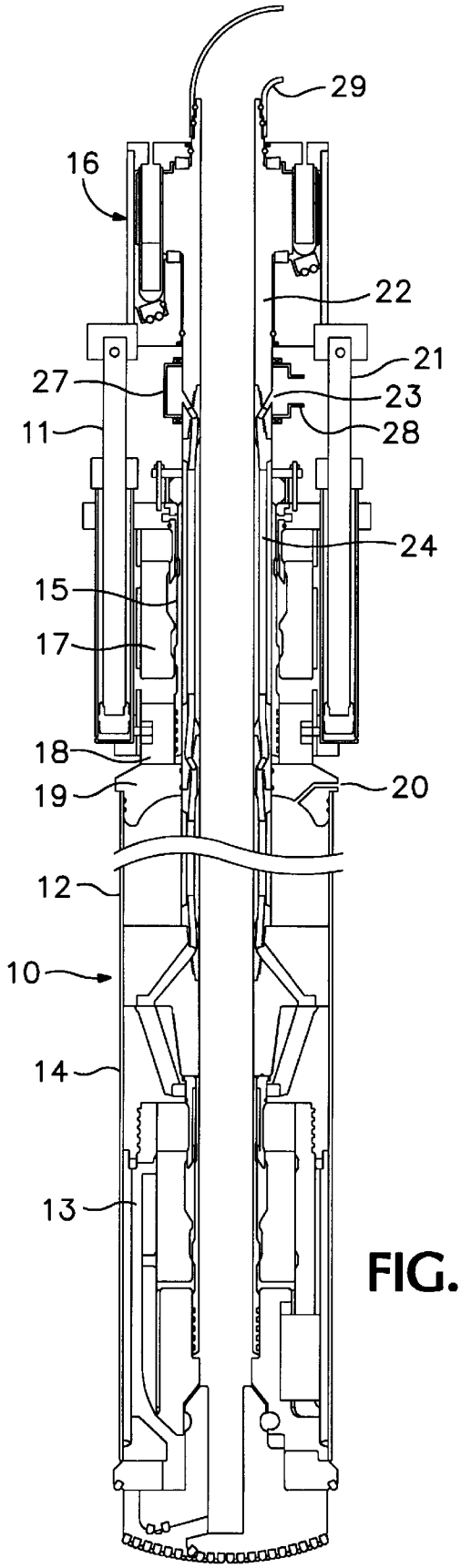
FIG. 1 is a partial cross-sectional view of a drilling assembly according to the present invention.
Figure 2:
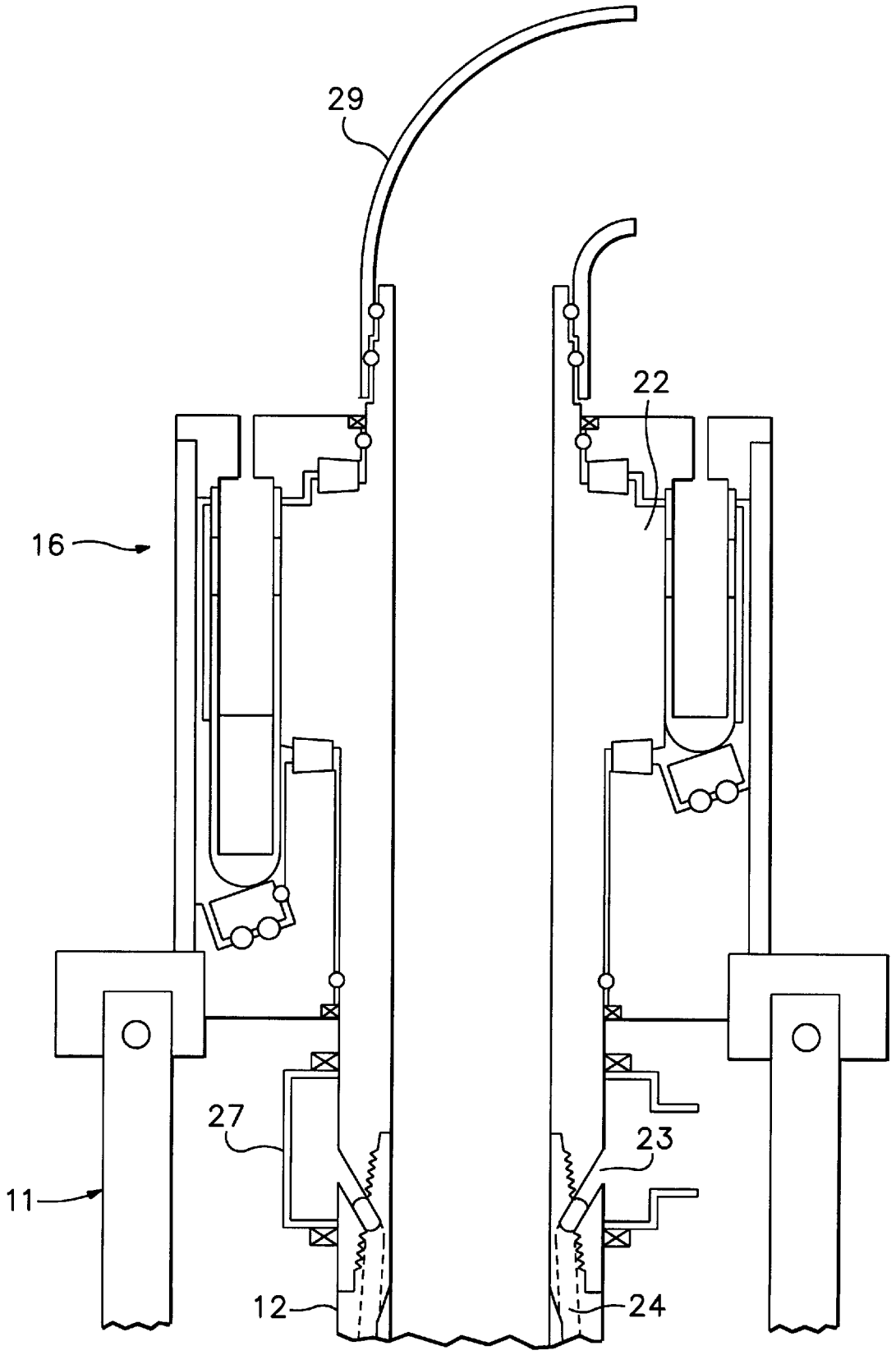
FIG. 2 is an expanded partial cross-sectional view of the assembly shown in FIG. 1, showing the power head assembly, compressed air inlet collar, and the upper terminus of the dual wall pipe assembly.
Figure 3:
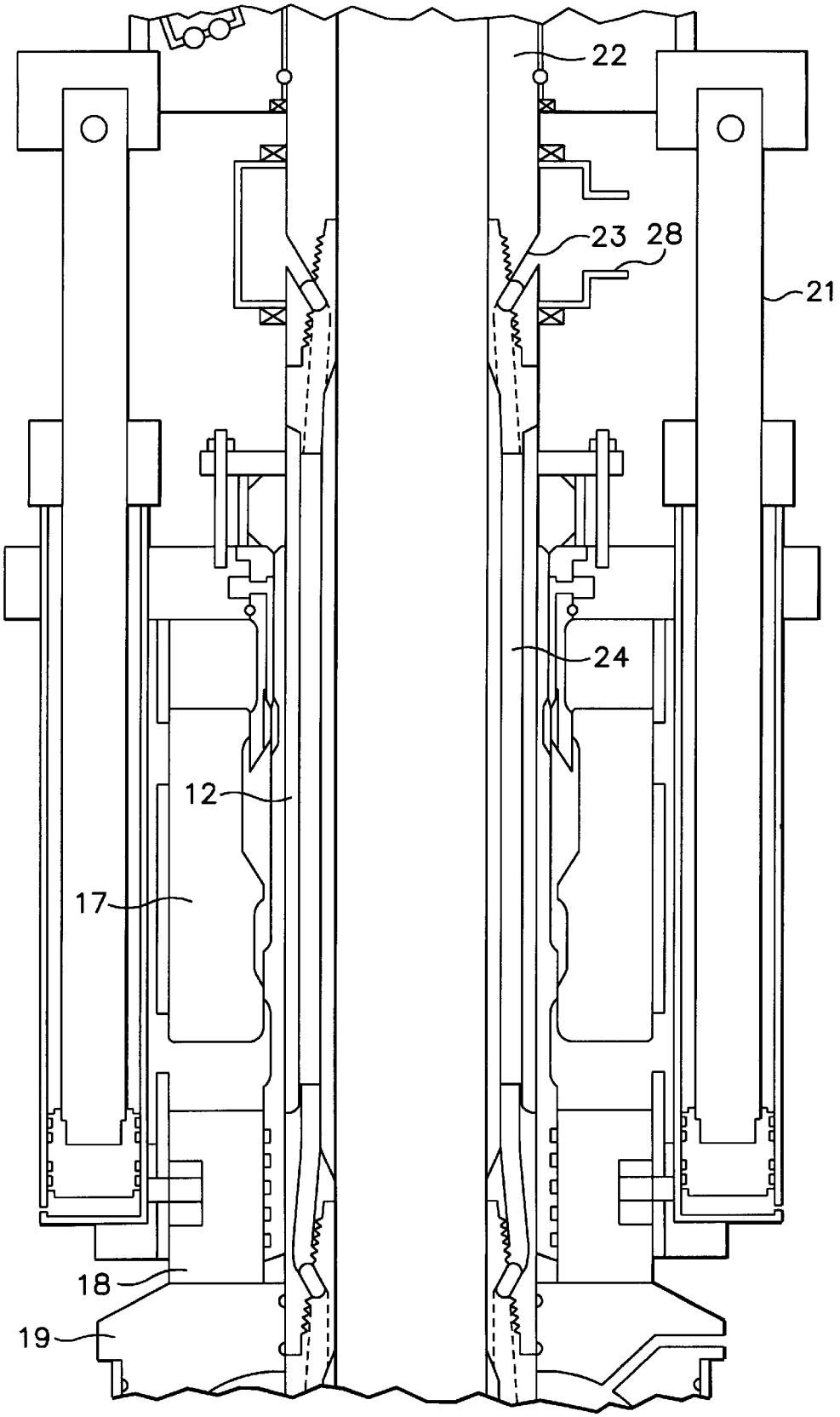
FIG. 3 is an expanded cross-sectional view of the assembly shown in FIG. 1, showing the casing driver in greater detail.

Referring now to FIG. 1, a reverse circulation drilling system, shown generally at 10, includes a head assembly 11, a dual wall pipe assembly 12, and a down hole pneumatic hammer 13 within a bore casing 14. Turning to FIGS. 2 and 3, head assembly 11 includes a casing driver 15 for driving the bore casing 14 downwardly as the bit advances, and a power head assembly 16 of standard design for rotating the bore casing 14 it is driven downwardly. Casing driver 15 includes an annular hammer 17 which reciprocates vertically as compressed air is alternatively admitted to chambers above and below hammer 17. Hammer 17 impacts on anvil 18, which in turn impacts on casing cap 19. Casing cap 19 is sealed against the inner surface of bore casing 14 to permit pressurization, through port 20, of bore casing 14 between casing cap 19 and down hole hammer assembly 13. Pressurization of the casing provides a downward flow of air between the casing and the down hole hammer, preventing upward migration of debris between the down hole hammer and casing, which can hinder the removal of the hammer. Power head assembly 16 is connected to anvil 18 through linkage assembly 21 to impart rotation to the dual pipe assembly and the down hole hammer. Power head assembly 16 is of a design generally known in the field, other than it central member 22, which is threaded onto the upper end of dual wall pipe assembly 14, includes a central bore in communication with the dual wall pipe assembly to extend the debris discharge path through the power head to the elbow 29. The joint of central member 22 and the dual wall pipe 14 includes a port 23 for admitting air to the annulus 24 between the inner wall 25 and the outer wall 26 of the dual wall pipe assembly. Collar 27 is mounted around the joint, and includes air inlet 28, through which compressed air is admitted into the dual wall pipe assembly for driving the down hole hammer as further described below. An elbow 29 is rotatably mounted and sealed to the upper end of central member 22. Elbow 29, central member 22 and the inner wall 25 of dual wall pipe assembly 14 together form a central drilling debris discharge tube for continuously discharging drilling debris from the down hole hammer as will also be described more fully below.

Figure 4:
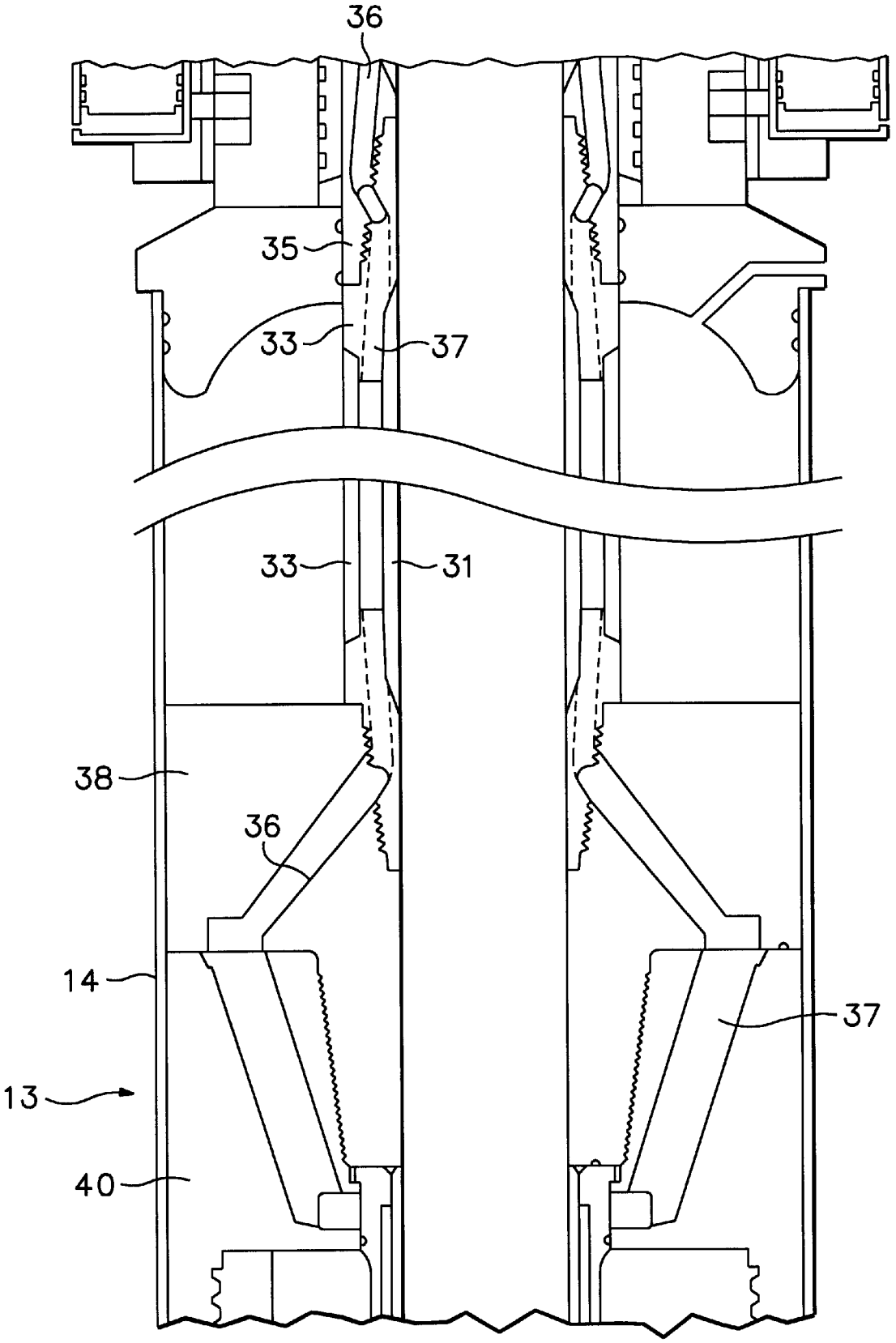
FIG. 4 is an expanded cross-sectional view of assembly shown in FIG. 1, showing the dual wall pipe assembly and the box and back head assembly connecting the lower terminus of the dual wall pipe assembly to the down-hole pneumatic hammer.

Turning also to FIG. 4, dual wall pipe assembly 12 is assembled from individual segments, each of which includes an inner pipe 31 and an outer pipe 33. Each segment includes a threaded male connector 33 and a threaded female connector 35 at opposite ends. Male connector 14 and female connector 15 each includes air ports 36 and 37 respectively which are in communication with outer annulus 24 of dual wall pipe assembly 11. At its upper end, dual wall pipe assembly is threaded in to central member 22 of power head 16. At its lower end, dual wall pipe assembly 11 is connected to the box 38, which in turn is threaded into back head 40 of down-hole hammer 13. Ports 42 an 44 communicate with annulus 24 of the dual wall pipe assembly to route compressed air therefrom into the down hole hammer.

Figure 18:
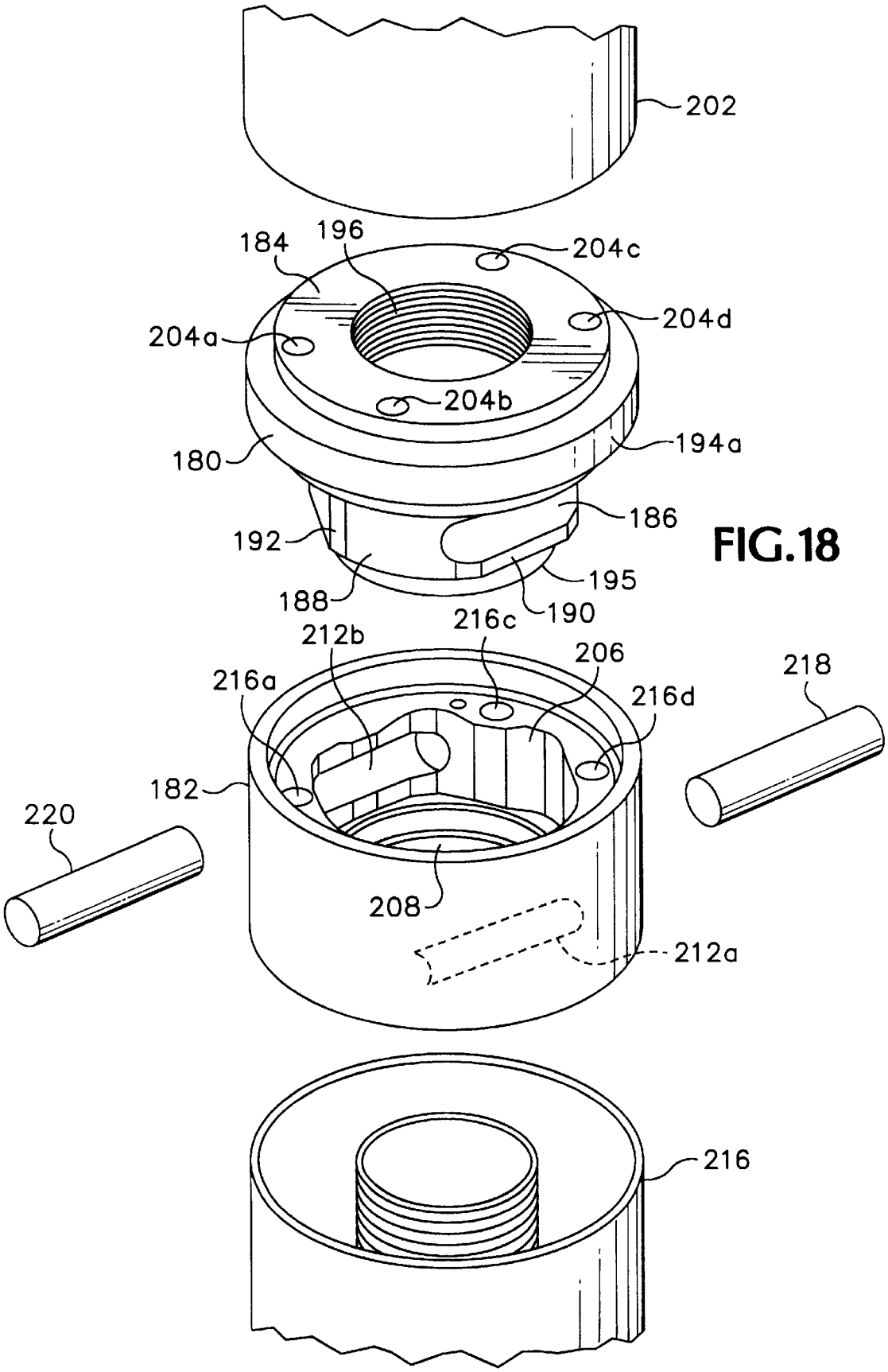
FIG. 18 is an exploded perspective view of a dual-wall pipe assembly having a hex-head coupling according to the invention.

Referring now to FIGS. 18–22, in an alternative embodiment the sections of dual-wall pipe are joined by way of male and female hex-head couplings 180 and 182 respectively, as shown in FIG. 18. Male coupling 180 includes an upper portion 184, a flange 186, and a faceted pin 188. Pin 188 includes six major surfaces 190, each adjacent pair of which is separated by a shorter surface 192. The interspersed shorter surfaces 192 are not essential to the invention, but are preferred as they facilitate ready engagement and disengagement of the coupling. Rounded channels 194*a* and 194*b* are formed in two opposite major surfaces for reasons more fully explained below. Pin 188 also includes a lower sealing surface 195 which engages a corresponding sealing surface on coupling member 182 as described below. A central axial bore 196 is formed through coupling 180. The upper portion is threaded at 198 to receive and seal the end of the internal pipe which forms the inner wall of the dual wall pipe assembly 202. Axial air holes 204*a*–*d* extend through upper portion 184 and flange 186, and index with corresponding axial air holes formed in coupling member 182, as further described below. Coupling member 180 is permanently affixed to a dual wall pipe assembly by first threading the threaded end of the inner tube of a dual wall pipe section, and then welding flange 186 to the outer tube of the pipe section. When attached in this way, axial air holes 204*a*–*d* communicate with the annular channel in the dual wall pipe section.

Coupling 182, the "box end" of the coupling, includes a hexagonal box portion 206 (See FIG. 19) into which pin 188 is inserted and locked to join pipe sections together. Below box 206 is an axial bore 208 which extends through the lower surface of coupling 182. Threads 210 are formed in bore 208 to engage the threaded end of the inner pipe of the dual wall pipe section. A pair of open channels 212*a* and 212*b* are formed in opposed sides of the hexagonal box 206. Channels 212*a* and 212*b* are sized and oriented so as to index with channels 194*a* and 194*b* and form a pair of cylindrical bores 214*a* and 214*b* when pin 188 is inserted into box 206. Axial air holes 216*a*–*d* are provided to communicate with the annular portion of the dual wall pipe section and the corresponding axial air holes 204*a*–*d*. As with coupling member 180, coupling member 182 is affixed to the dual wall pipe section by being threaded onto the threaded end of the inner pipe, and then welded at 216 to the outer wall of the dual pipe section.

Figure 19:
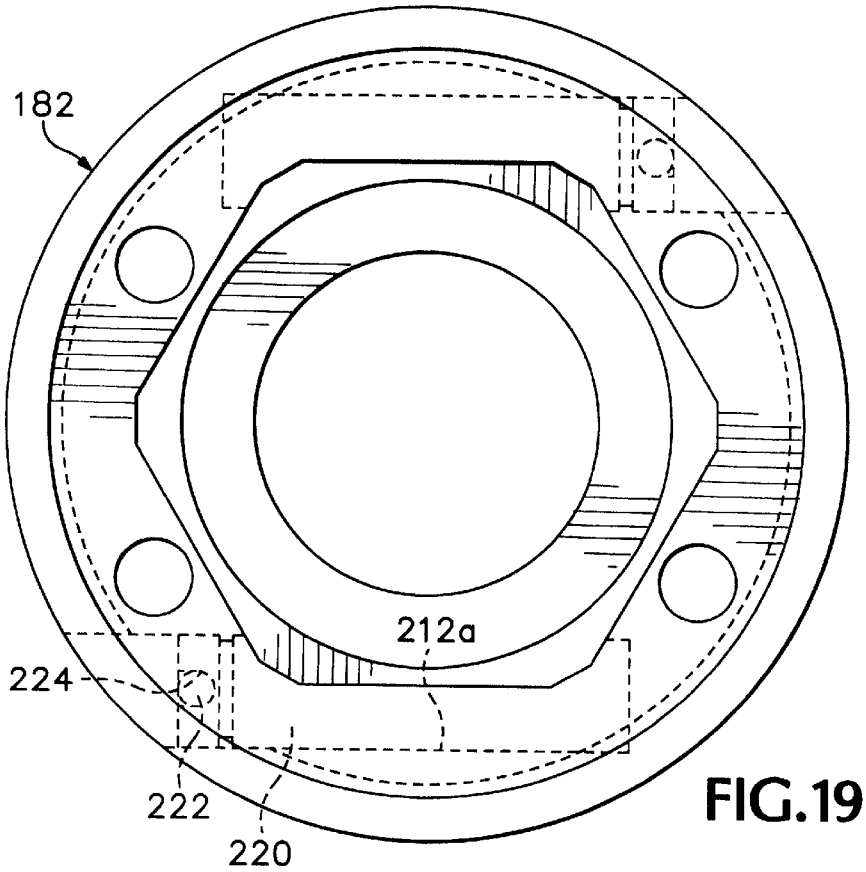
FIG. 19 is a top plan view of the box portion of the coupling shown in FIG. 18.
Figure 20:
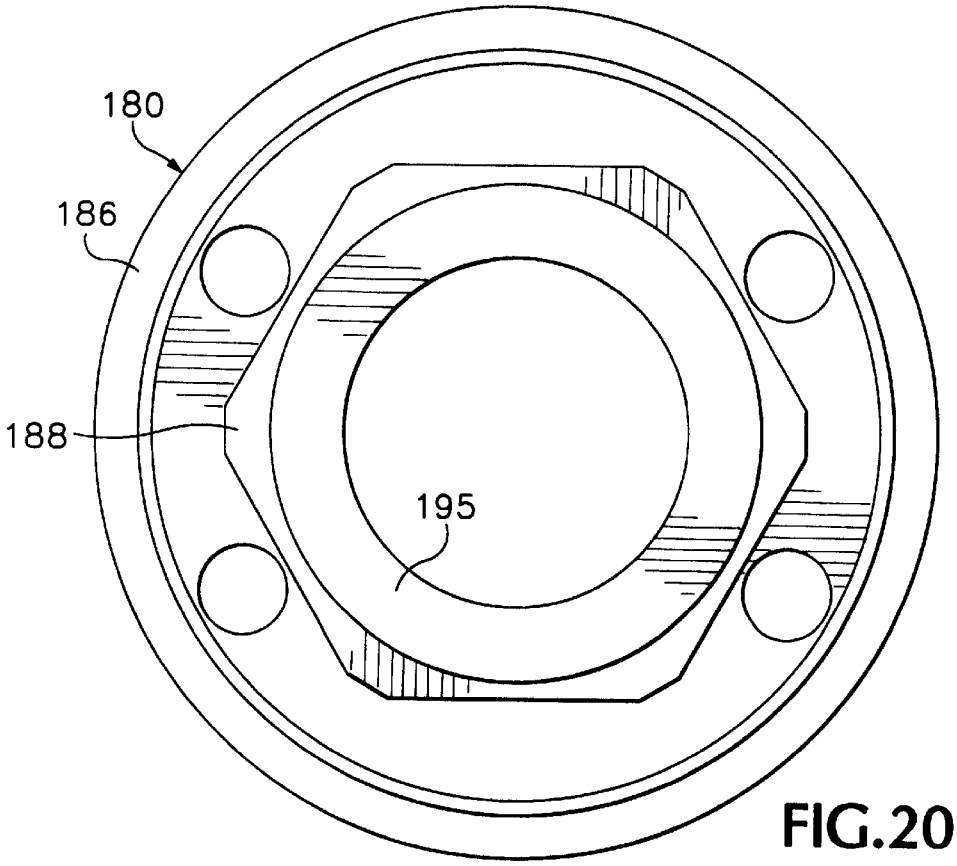
FIG. 20 is a side elevational view of the box portion of the coupling shown in FIG. 19.
Figure 21:
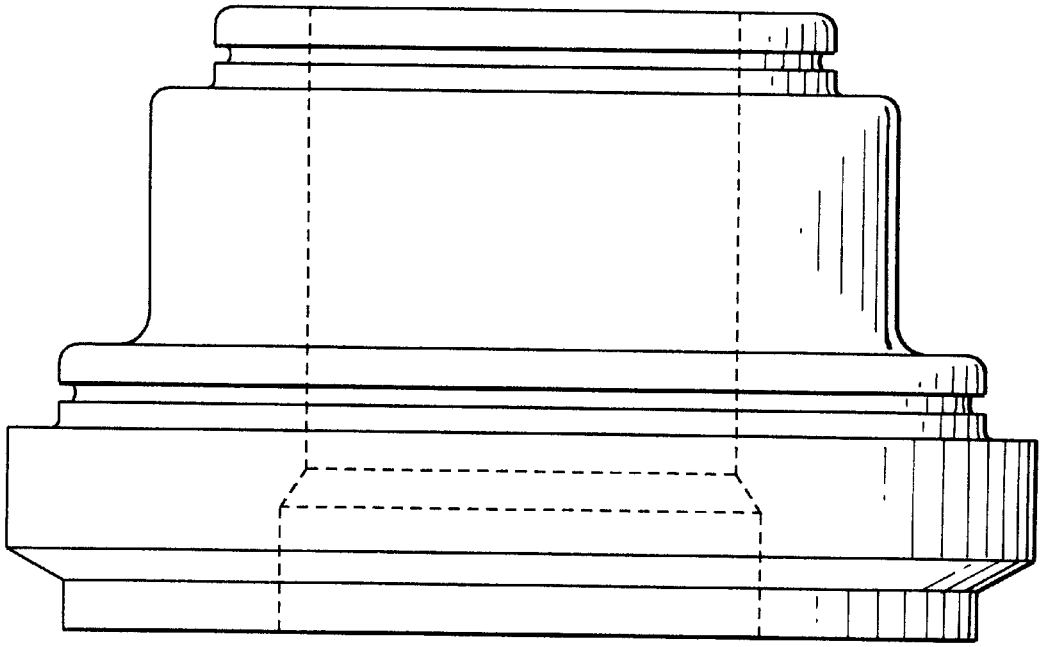
FIG. 21 is a bottom plan view of the pin portion of the coupling shown in FIG. 18.
Figure 22:
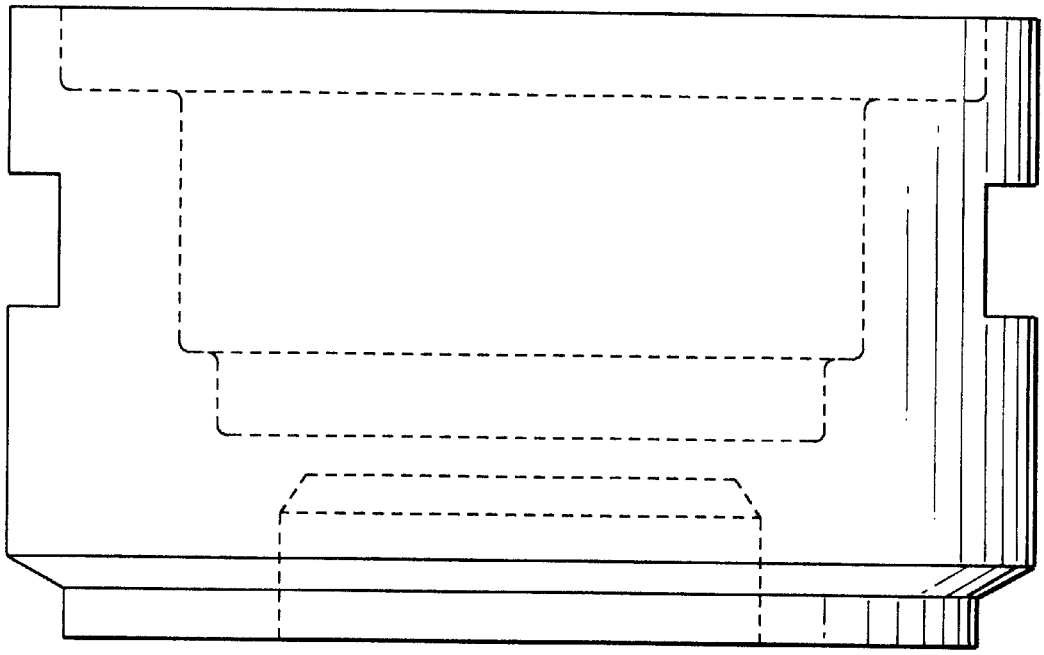
FIG. 22 is a side elevational view of the pin portion of the coupling shown in FIG. 21.

The coupling members are joined as follows. Pin 188 is inserted into box section 182. Pins 218 and 220 are then inserted into bores 214*a* and 214*b*, locking the coupling halves together. Pin 218 is retained in bores 214*a* by a pin 222 which is slidably fitted in a small axial bore 224 which intersects bore 214*a* (FIG. 19). A spring (not shown) is fitted into bore 224 below pin 222, and urges pin 222 upwardly into bore 214*a*, retaining pin 214*a* therein. Pin 220 is retained in bore 214*b* in a similar manner. To insert pin 218 into its respective bore, pin 222 is urged downwardly into bore 224, pin 218 is slid past into bore 214*a*, and pin 222 is released. The spring in bore 224 then urges pin 224 upwardly into bore 214*a*, locking pin 218 therein. Pin 220 is inserted into bore 214*b* in a like manner. In this manner, pipe sections can be quickly and easily assembled and dissembled, using only hand tools.

Figure 5:
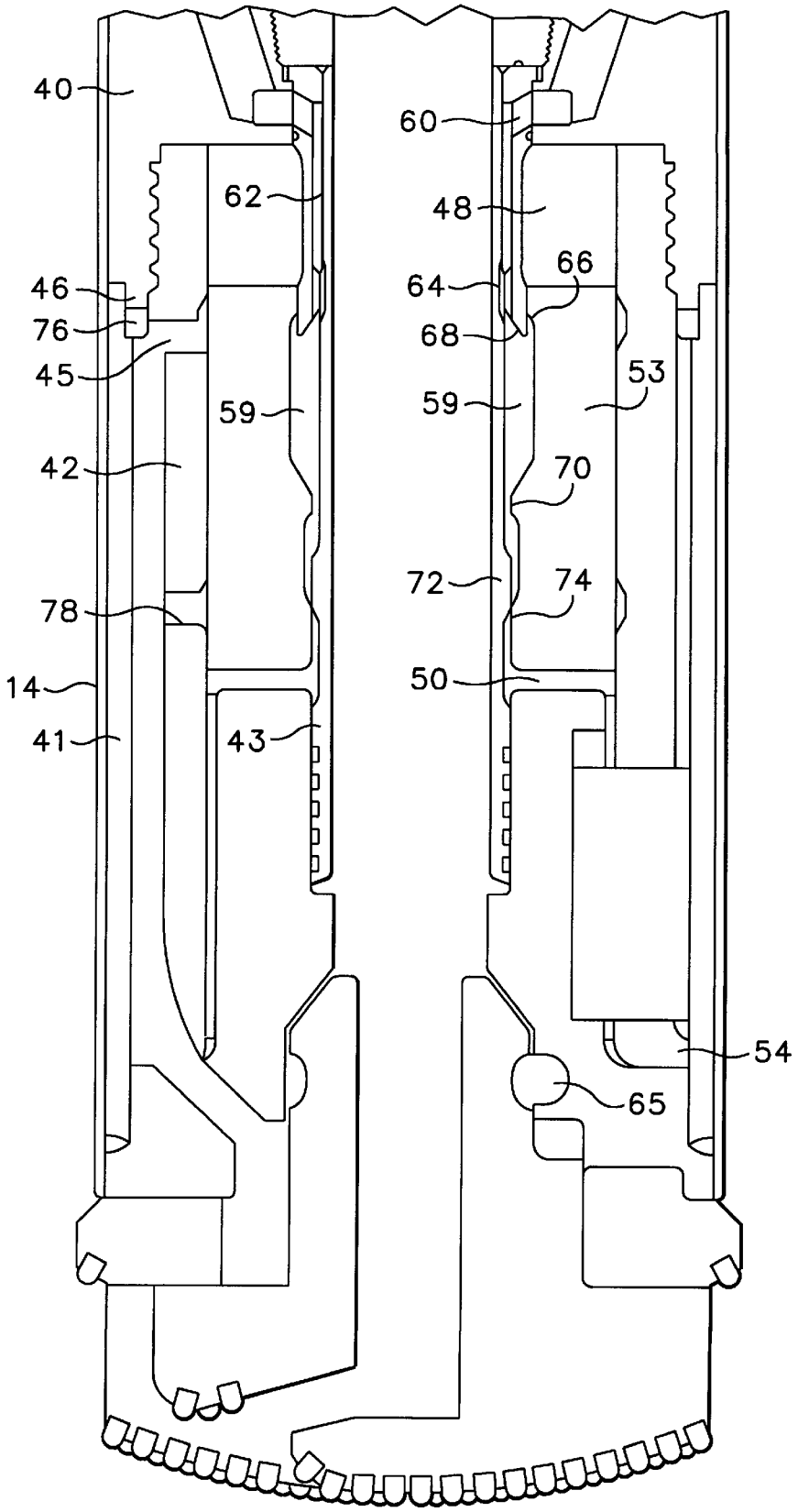
FIG. 5 is a cross-sectional view of the down-hole pneumatic hammer assembly, including the bit assembly.
Figures 5A, 6A:
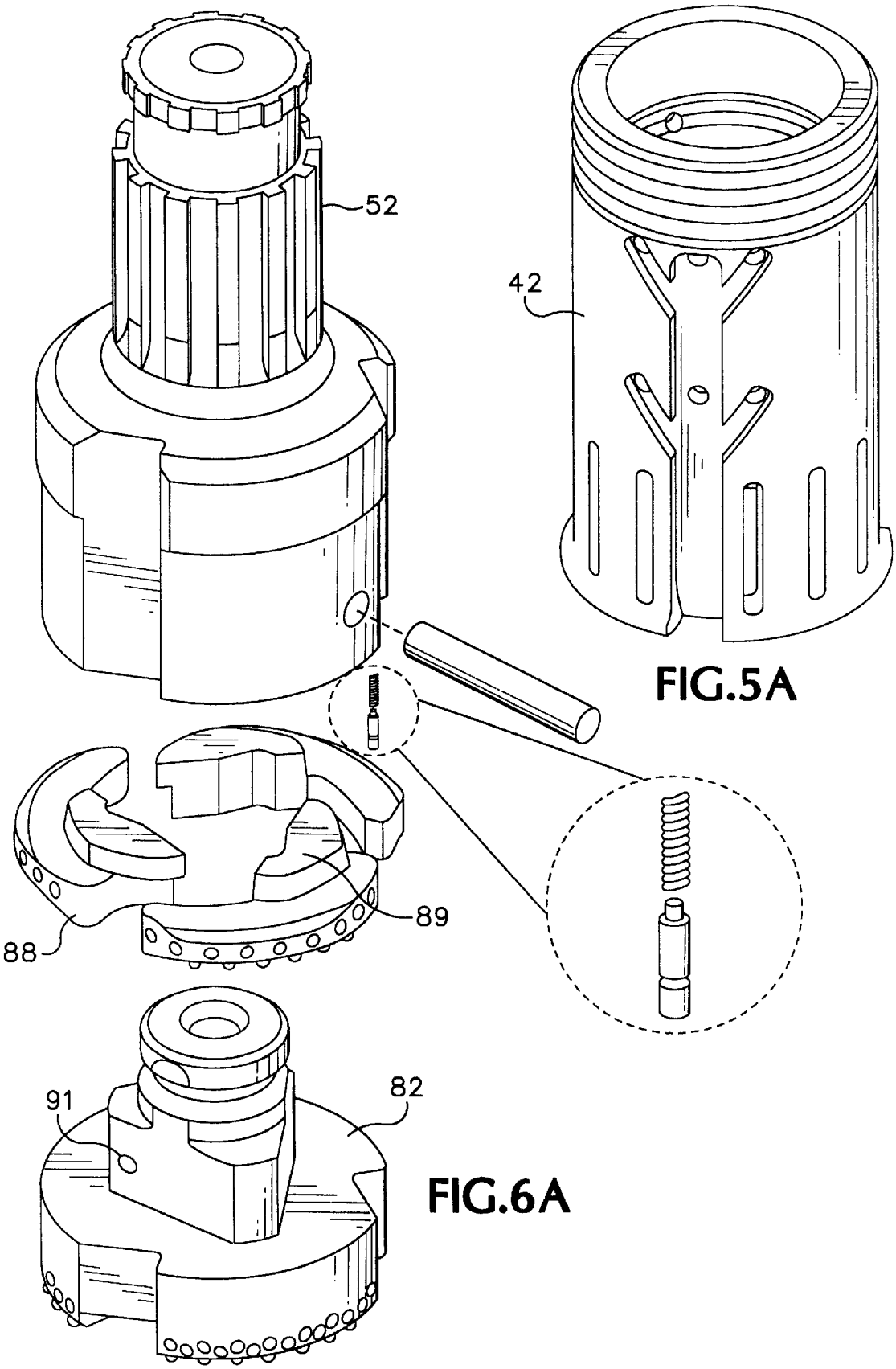
FIG. 5A is a perspective view of an alternative design for the hammer barrel of the down-hole pneumatic hammer assembly.
FIG. 6A is an exploded perspective view of a first embodiment of a bit assembly according to the present invention.
Figure 6B:
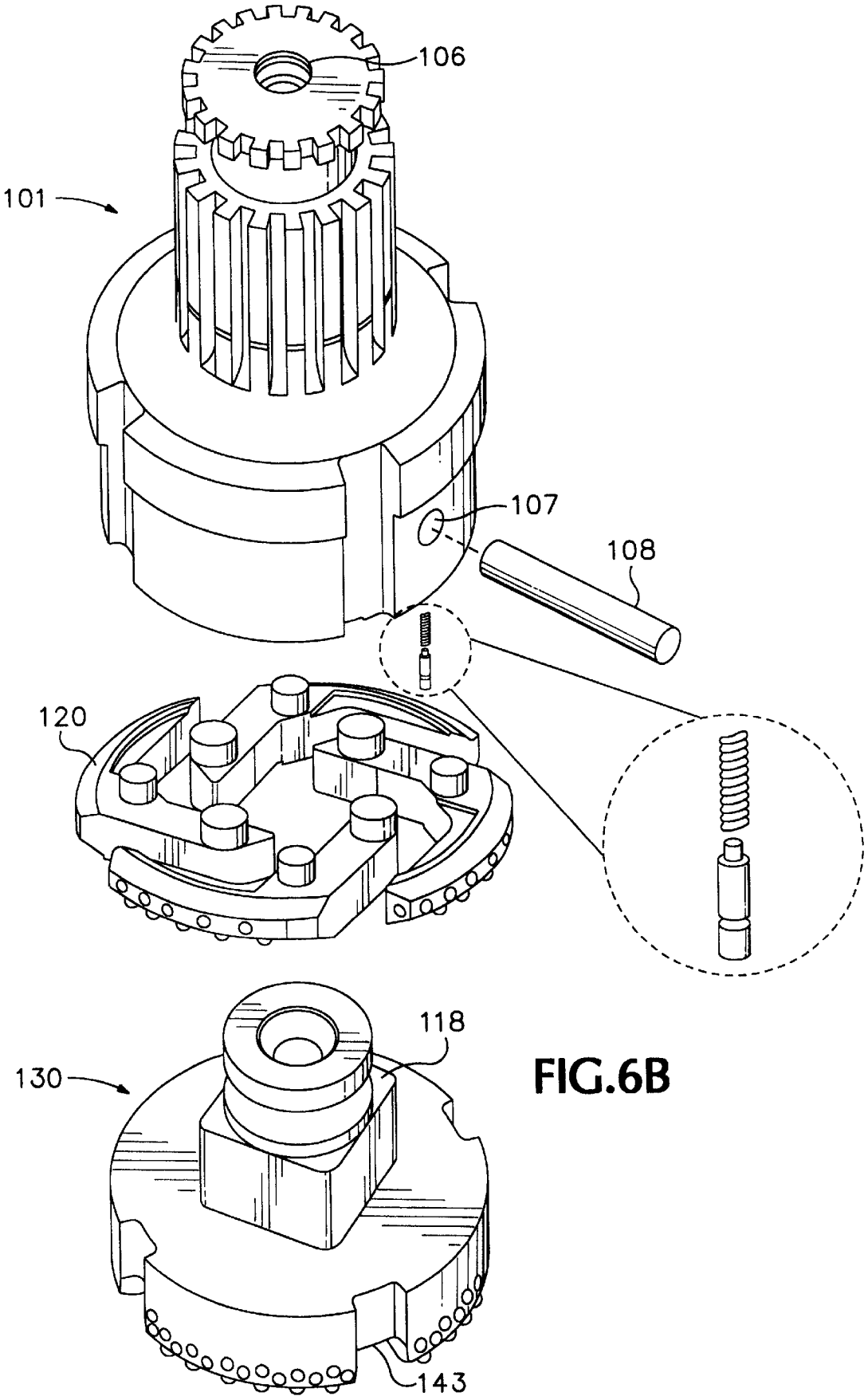
Figure 7A:
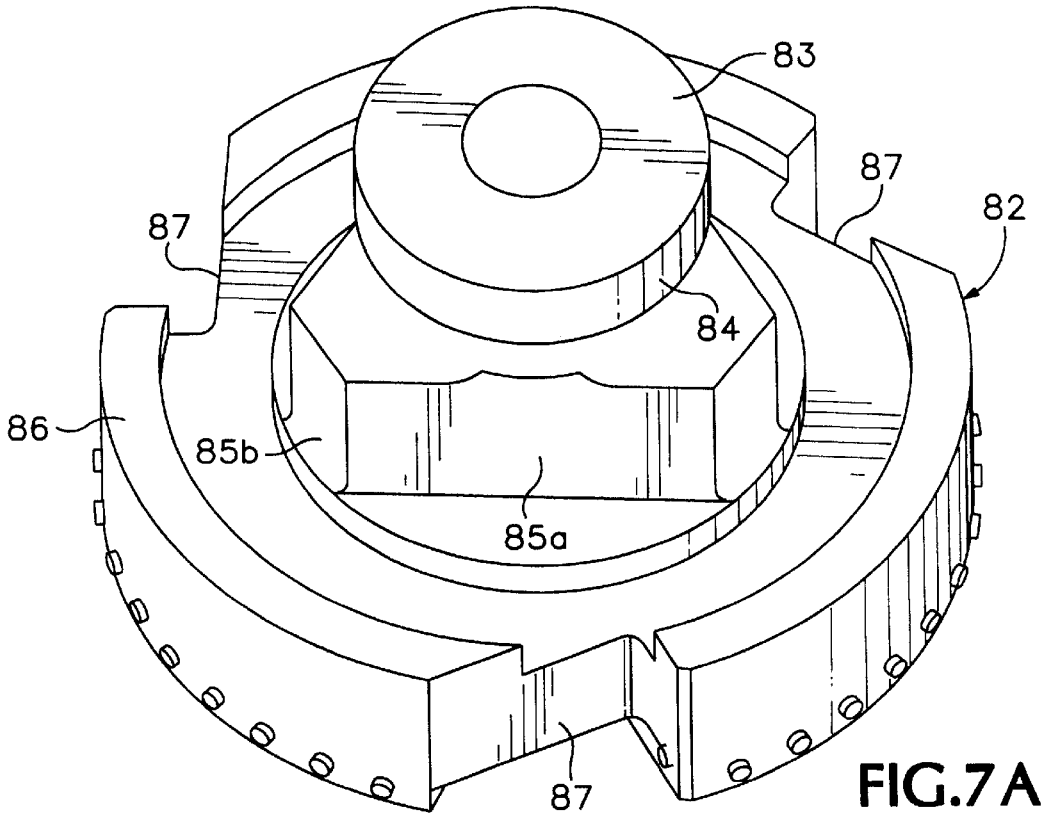
FIG. 7A is a perspective view of the pilot bit on the embodiment of FIG. 6A.
Figure 7B:
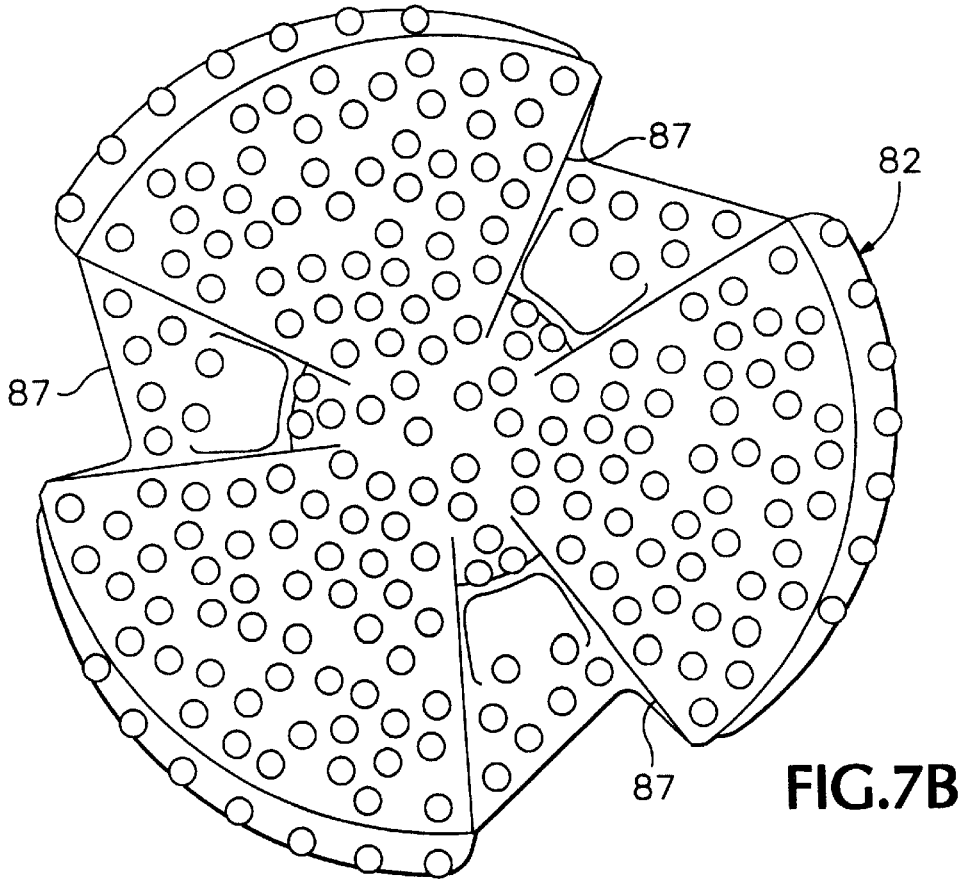
FIG. 7B is a bottom view of the pilot bit shown in FIG. 7A.
Figure 8:
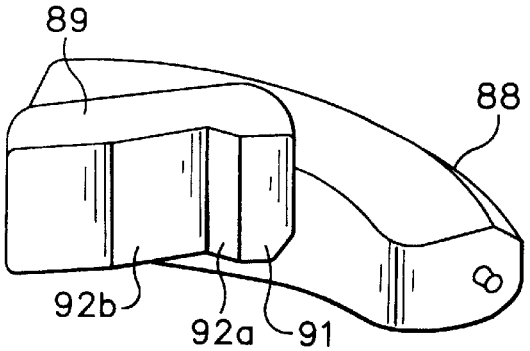
FIG. 8 is a perspective view of an underreamer arm used in the embodiment shown in FIG. 6A.
Figure 9A:
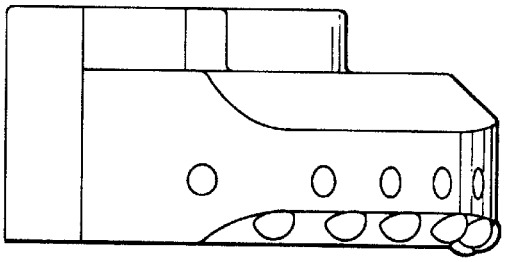
FIG. 9A is an end view of the underreamer arm shown in FIG. 8.
Figure 9B:
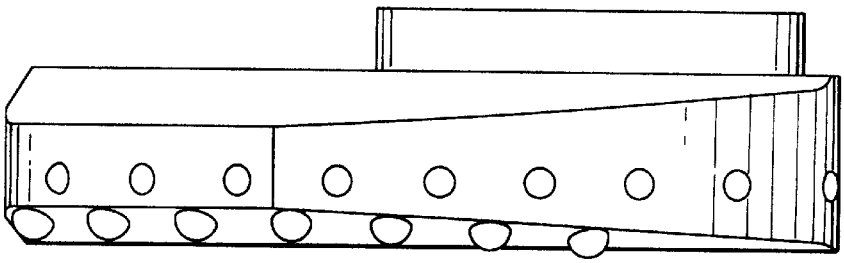
FIG. 9B is an outer side view of the underreamer arm shown in FIG. 8.
Figure 10:
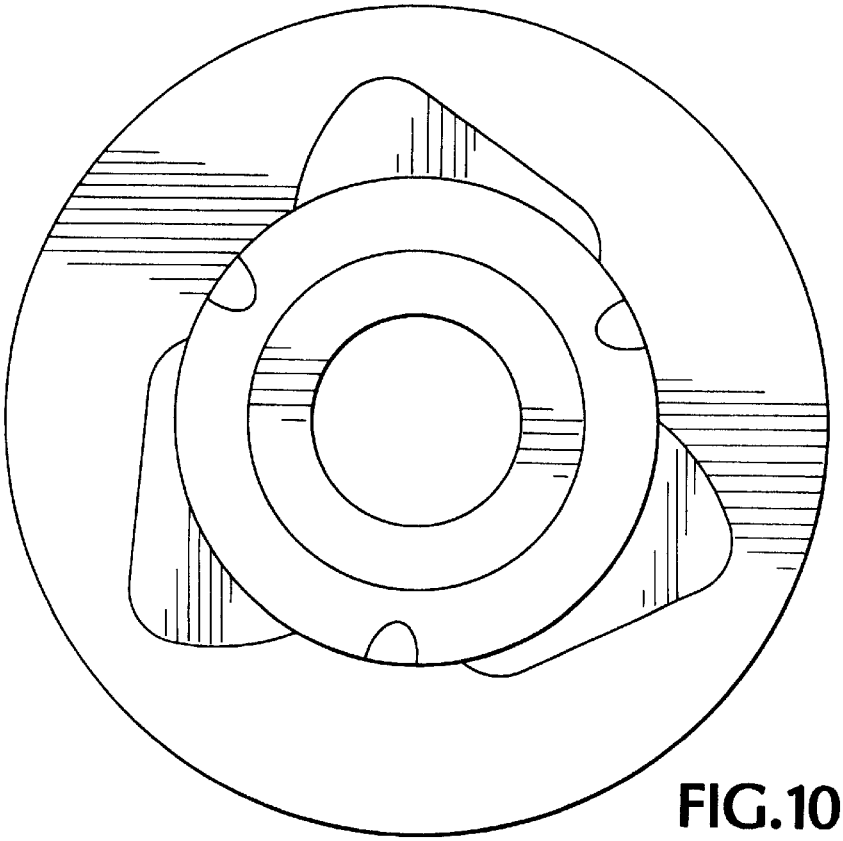
FIG. 10 is a bottom view of the bit driver of the embodiment shown in FIG. 6A, showing the axial surfaces which define the recesses which receive the underreamer arms, and the axial surfaces bear against the underreamer arms to rotate the arms about the pilot bit for extension and retraction.
Figure 11:
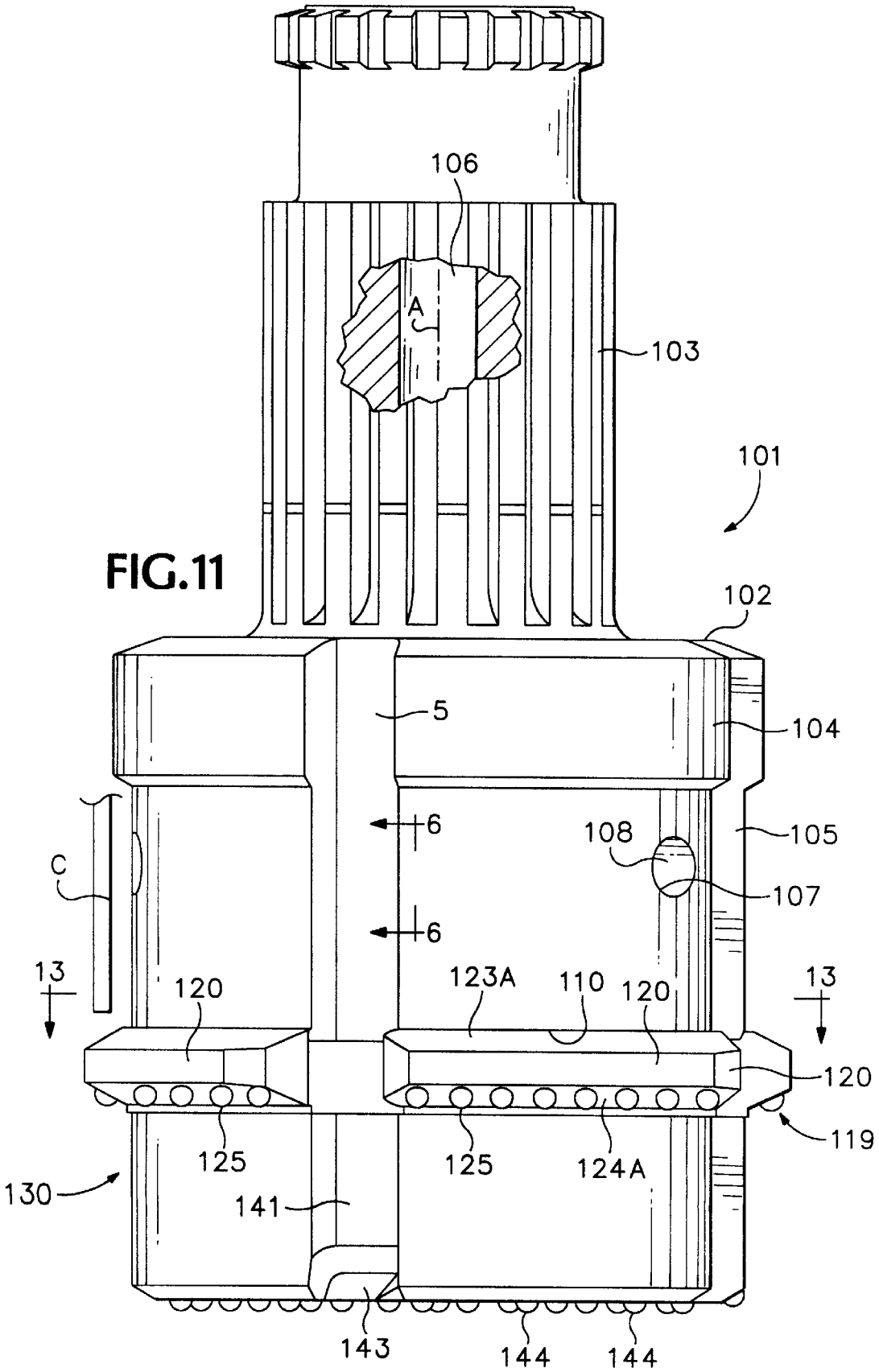
FIG. 11 is side elevation view of the bit assembly shown in FIG. 6B.

Turning now to FIG. 5, down-hole hammer 13 includes box 38 threaded onto back head 40. A sleeve 41 and a hammer barrel 42 are threaded into back head 40. A centrally located discharge tube 43 is pressed into sleeve 41. A wear sleeve 44 is fitted around hammer barrel 40, and press fitted over ring 45 and onto shoulder 46 of back head 40. Sleeve 41 and barrel 42 define an annular upper air chamber 48. Central evacuation tube 43 and barrel 42 define an annular lower air chamber 50. The lower end of barrel 42 abuts bit driver 52, and also includes a perimetrical lip 54 which engages wear sleeve 44 to center barrel 42 in the wear sleeve. Hammer 53 is slidingly fitted into barrel 42 for reciprocation. Bit driver 52 is slidably fitted into barrel 42 below hammer 53, and over the lower end of central evacuation tube 43. Bit driver 52 is retained in barrel 42 by a plurality of keys 56, each of which is fitted into a keyway 58 and annular recess 60 of bit driver 52. (See also applicant's U.S. Pat. No. 5,511,628, incorporated by reference above, for detail of an alternate barrel assembly incorporating a like key and keyway assembly for mounting the bit driver in the hammer barrel.) The key-keyway assembly permits the bit assembly to advance ahead of the dual wall pipe assembly during drilling. Bit assemblies for use with the present invention are shown in FIGS. 6–10. In one embodiment (FIG. 6A), a bit assembly consists of a bit driver 52, a pilot bit 82, and arms 88*a–c*. Bit driver 52 includes an upper shank 83 having a recessed chamfer 84, camming surfaces 85*a* and 85*b*, and a lower portion 86. Lower portion 86 includes three peripheral recesses 87*a–c*. Hardened drilling buttons, preferably made of a carbide material, are mounted on the peripheral and bottom surfaces of the pilot bit (FIG. 7). Arms 88*a–c* are nested atop pilot bit 82, and slide thereon in an prescribed arcuate path defined by as will be described. Each of the arms includes a raised boss 89 which is received into corresponding recess 90 of bit driver 52 (FIG. 10). Raised boss 89 serves several functions. First, impact forces from the hammer are transmitted downwardly to the pilot bit 52 through bit driver 52, boss 89, and arm 88. Second, boss 89 is received and retained in recess 90, where it rotates through a limited arc to extend and retract arm 88. With arm 88 in its retracted position, surface 91 is adjacent camming surface 85*a*. In this configuration, the overall diameter of the bit assembly is less than the inner diameter of the bore casing, permitting the bit assembly to be withdrawn from the bore. As arm 88 is rotated clockwise about pilot bit 82 by clockwise rotation of bit driver 52, angled surfaces 85*a* engage surface 92 and urge arm 88 outwardly. The rotation and extension of arm 88 continues until surface 92*a* is abuts surface 85*b*, and surface 92*b* abuts surface 85*a*, locking arm 88 in its extended position. To unlock and retract arm 88, bit driver 52 is rotated in the opposite direction. In its fully retracted position, the overall diameter of the underreamer assembly is less than the inside diameter of the casing, permitting withdrawal of the entire underreamer bit assembly through the casing if necessary. This feature represents a significant advance over known underreamers, which cannot be retracted and withdrawn through the casing if necessary.

In operation, compressed air is delivered into annular chamber 59 through port 37, radial ports 60, annulus 62 and axial ports 64. In FIG. 5, hammer 53 is shown during its downward stroke. Lip 66 is engaged with lip 68, sealing off chamber 48. Lip 72 is engaged with lip 74, sealing off chamber 50. Port 78 is closed. As piston 53 continues downwardly, port 76 is uncovered, exhausting chamber 48. At about the same time, lip 74 disengages from lip 72, admitting a fresh charge of compressed air into chamber 50 to raise piston 53 to its upper position after it has struck bit driver 52. As piston 53 rises, port 78 is uncovered, exhausting chamber 50. Lip 74 engages lip 72, sealing chamber 50. Port 76 is sealed by piston 53, and lip 66 disengages from lip 68, admitting a fresh charge of compressed air into chamber 48. The fresh charge of compressed air in chamber 48 drives piston 53 downwardly to begin another stroke. The compressed air exhausted into ports 76 and 78 is collected in port 80 (FIG. 5A), and discharged through the bit assembly into central evacuation tube 43, carrying with it drilling debris and earthen fragments dislodged by the bit. As an added precaution against drilling debris becoming lodged between arms 88*a–c* and the pilot bit, in the bit assembly embodiment shown in FIG. 6B, port 91 is provided through which compressed air can be discharged to clear debris.

The flow of compressed air through the bit assembly is essentially continuous, and provides a continuous evacuation of drilling debris from the drilling face of the bore. Moreover, the essentially constant diameter of the evacuation tube and inner wall of the dual wall pipe assembly provides a constant air velocity, which further aids debris removal. The continuous removal of debris through the central evacuation tube promotes continuous drilling. It is seldom, if ever necessary to stop drilling and raise the bit to clear debris from the bore. Significant improvements in drilling rates can directly result. In addition, it is possible to obtain a relatively accurate "core" sample from the bore which can provide useful information in both exploratory and environmental applications.

An alternative bit assembly is shown in FIGS. 6B and FIGS. 11–17. The reference numeral 101 indicates generally the present drill bit assembly for attachment to the lower end of pneumatic down hole hammer. A driver at 102 includes a shank 103 of a diameter and splined for attachment to the percussive hammer. Integral with the shank is a driver head 104. About head 104 are circumferencially spaced channels 105 for upward passage of earthen particles or debris. An axially extending bore 106 of the driver receives a pressurized downward air flow for particle removal. Head 104 is cross bored off center at 107 to receive pin 108 engageable with a later described pilot bit of the drill assembly.

Figure 13:
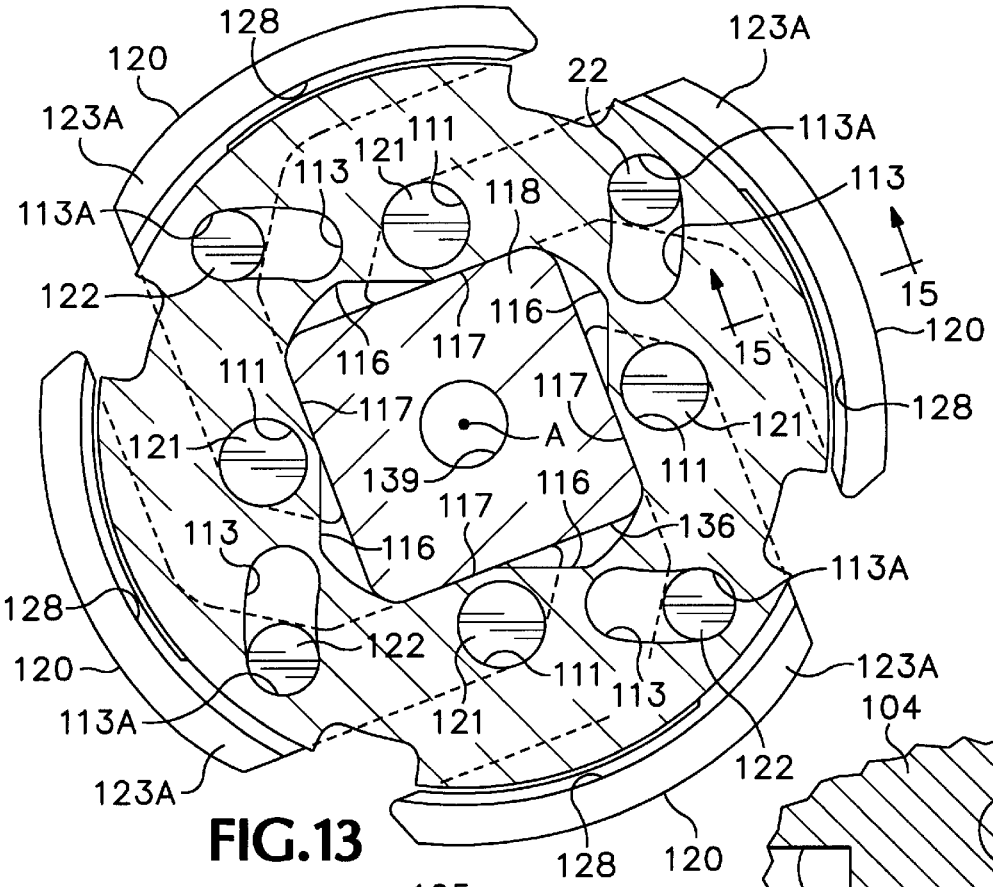
FIGS. 13 and 14 are horizontal sectional views taken along line 3—3 of FIG. 11 and showing the lower portion of the driver receiving the underreaming arms with the arms shown extended and retracted.
Figure 15:
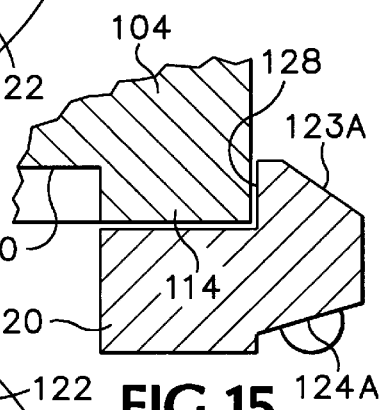
FIG. 15 is a vertical sectional view taken along line 5—5 of FIG. 13 showing a fragment of the driver bottom wall and an arm locking pad thereon.
Figure 14:
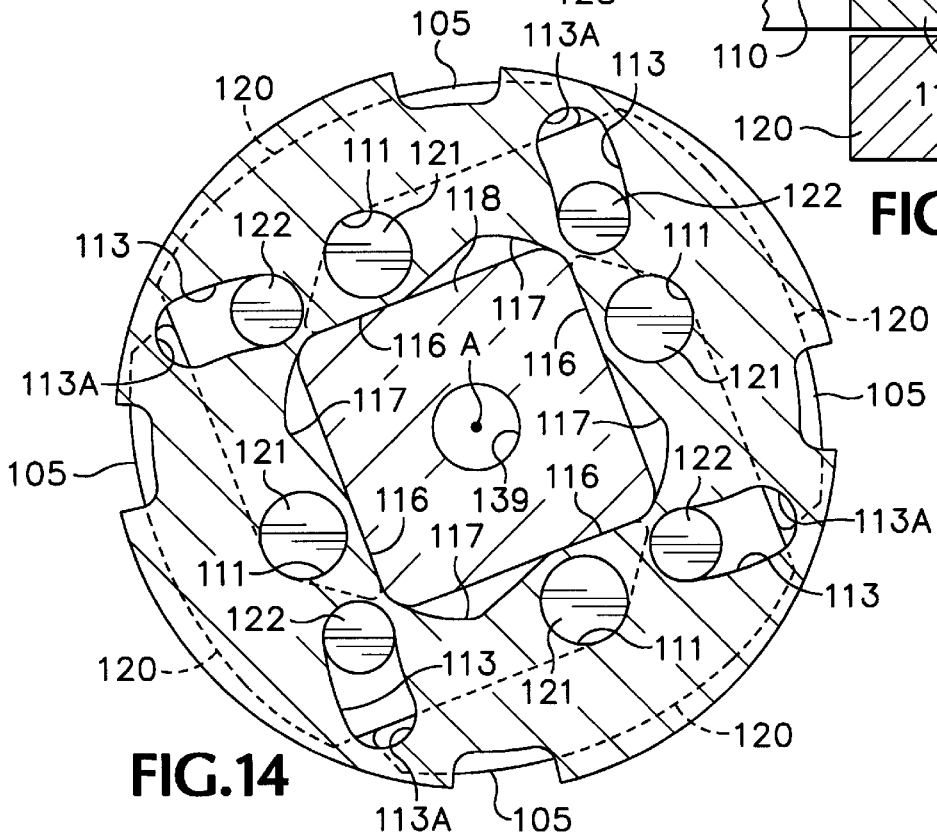
Figure 16:
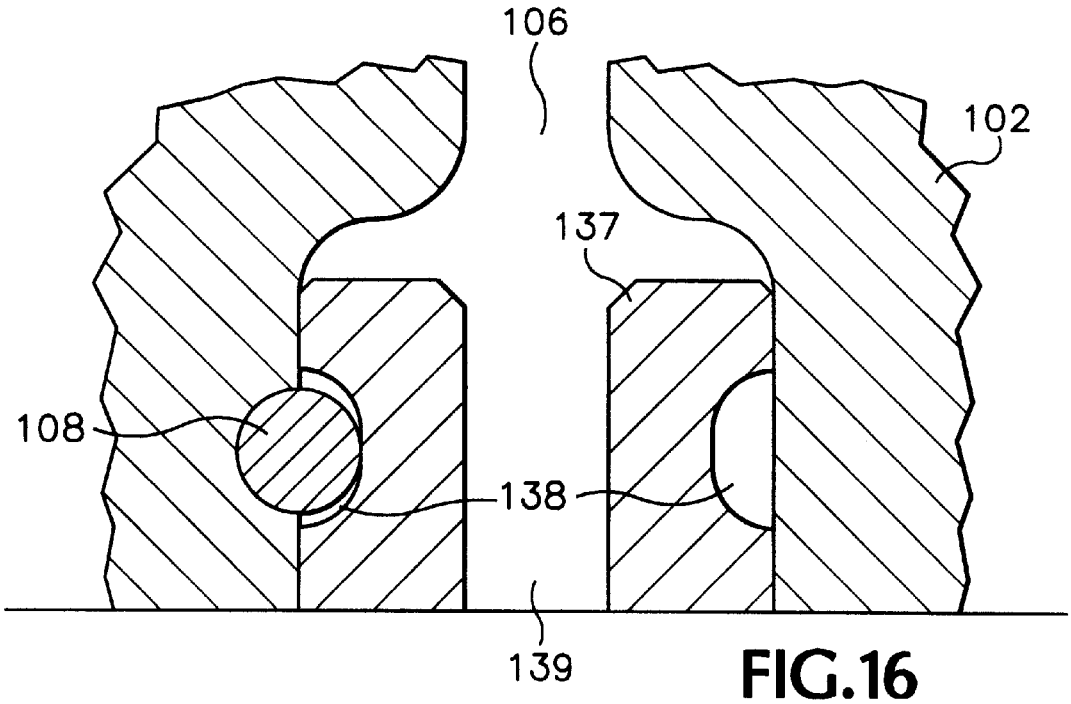
FIG. 16 is a vertical sectional view taken along line 6—6 of FIG. 11.
Figure 17:
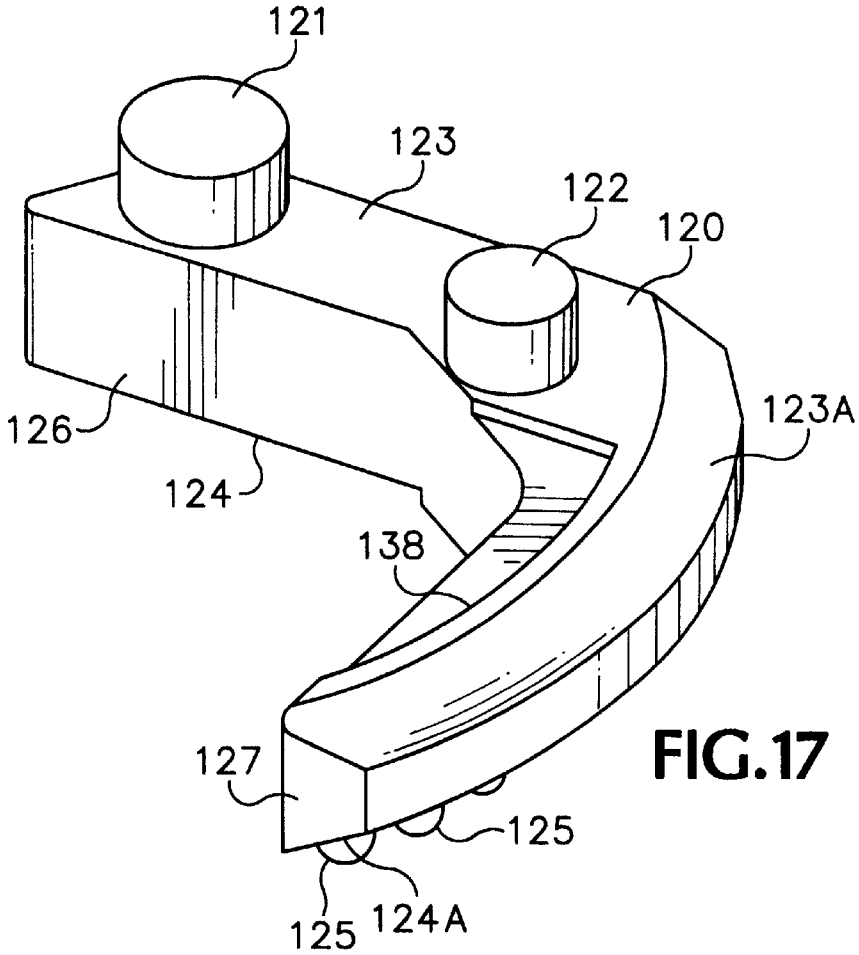
FIG. 17 is a perspective view of an underreamer arm.

A lowermost surface 110 of the driver head 104 defines a series of cylindrical sockets 111 uniformly spaced apart and from vertical axis at A of the driver (FIG. 13). Each socket has a companion elongate recess 113 formed in the lower portion of the driver to receive a limit stop pin of a later described underreamer arm. Additionally, lowermost surface 110 of head 104 is provided with multiple arm lock pads 114 in the form of downward projections which serve to lock each underreamer arm in an extended operative position. An internal wall of the driver includes segments 116 and 117 which define an open area which receives a cam block 118 and permits head movement thereabout. Irregular wall surfaces 116–117 alternately abut the cam block to limit driver rotation during arm positioning as later discussed.

Figure 12:
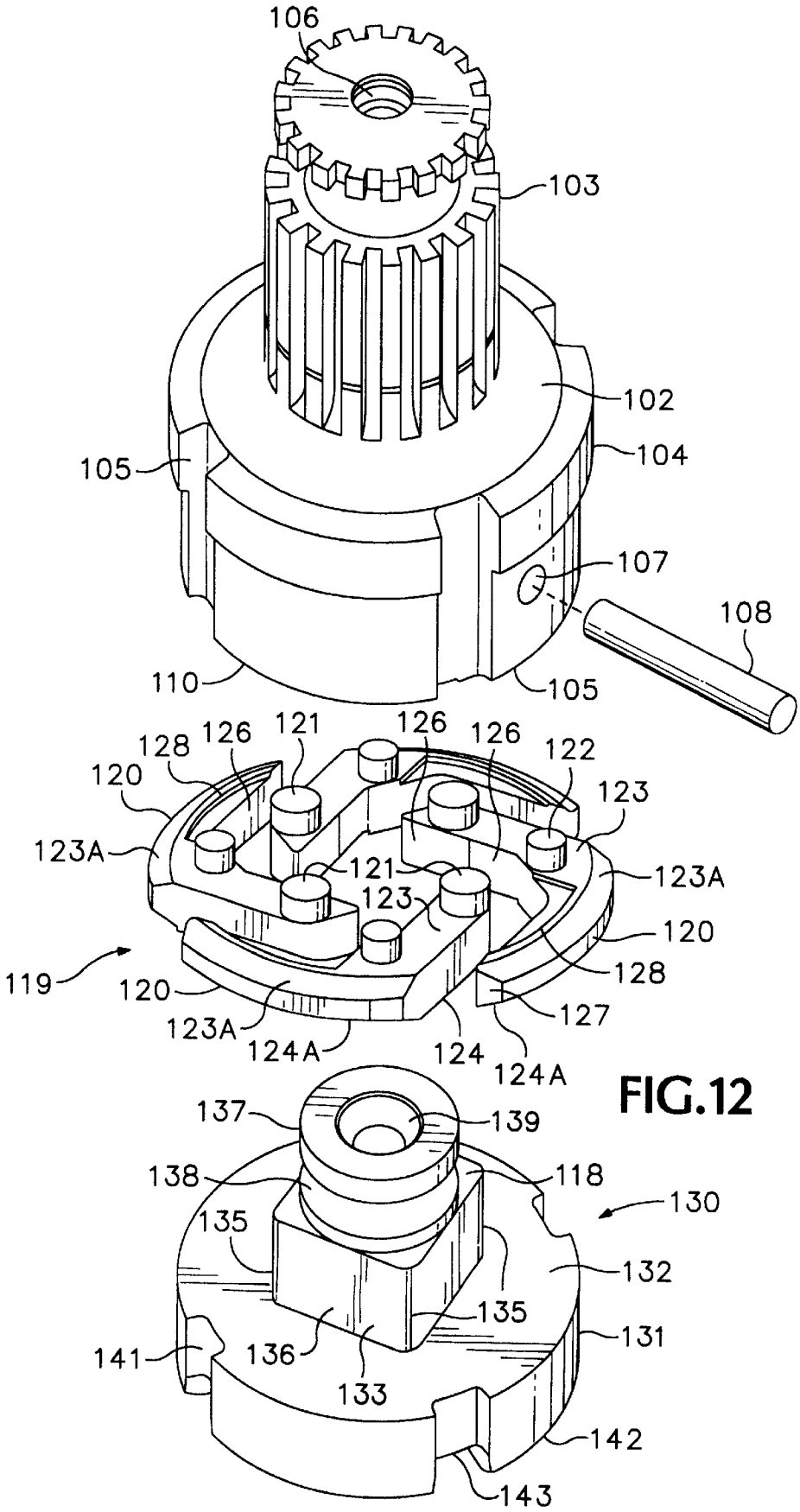
FIG. 12 an enlarged exposed view of the bit assembly shown in FIG. 11.

A set of underreamer arms are indicated generally at 119 in FIG. 12 with the following description of one arm applicable to all of the arms at 120 which are generally of angular shape in plan view. With attention also to FIG. 17, an arm pivot post 121 seats in a socket 111 formed in the underside of head 14 of the driver. A limit stop post or pin 122 of the arm projects upwardly into an elongate recess 113 in the underside of the driver head 104 with an end wall 113A of the recess limiting outward displacement of arm limit stop pin 122. Arm top and bottom walls are at 123–124 which both terminate outwardly in beveled arm outer edges 123A–124A, the lower beveled edge being provided with carbide inserts or buttons 125. An inner side wall 126 of an arm 120 moves about in relation to a later described cam block during arm deployment and retraction. A rearwardly beveled (relative arm rotation) arm end wall is at 127. Beveled arm edge 123A is engageable with the lower edge of a hole installed casing to contribute to inward arm movement during arm retraction at the end of a drilling operation. An arm shoulder at 128 cooperates with the lock pads 114 on the driver when deployed. The inner side wall 126 of each arm 120 travels along a wall surface of the cam block during arm positioning.

A pilot bit is generally indicated at 130 and includes a main body 131 having an uppermost surface 132 on which is centrally located cam block 118 with walls 136. Integral with cam block 118 is a pedestal 137 having an annular groove 138 thereabout to receive head carried pin 8 in a tangential manner. Groove 130 is oversize to permit upward displacement of driver 12 during arm positioning and subsequent locking of the arms. A compressed air central passageway is at 139 of the bit and is in registration with driver air passageway 106. Spaced about the lower perimeter 131 of drill bit 130 are channel 141 through which debris flows upwardly past the arms during a drilling operation. A bottom wall 142 of the drill bit defines radially disposed air channels 143 which are served with compressed air flows via internal passageways served by axial passageway 139. The lowermost surface 142 of the drill bit is suitably equipped with tungsten carbide buttons or other wear resistant members 144 commonly used in earth drilling equipment.

In drilling and underreaming operation pilot bit 130 advances into the ground with the underreamer arms locked in a deployed position below and radially beyond the advancing end of the casing at C. Casing movement is facilitated by the relatively large underreamed area, and if required, by the casing driver 15. In one embodiment, if the drill bit assembly advances more than a predetermined distance ahead of the casing, linkage 21 operates a valve to provide compressed air to the pneumatic hammer 17 and associated porting casing driver 15.

At completion of the operation, the driver is partially rotated in the direction opposite to drilling rotation to shift the arm pivot pins and specifically the arm inner ends along cam block walls 36 to retract each arm. Arm retraction is aided by the beveled arm outer edges 123A engaging the bottom edge of casing C during retraction at the end of a drilling operation to permit removal of the drill bit assembly through the casing.

In operation with arms 53*a–c* extended, exhaust air from the down-hole hammer flows from port 42 through driver 51, arms 54*a–c,* pilot bit 56, and into central evacuation tube 17 (FIG. 2), carrying with it drilling debris. Applicant's routing of exhaust air from the down-hole hammer through the driver and into the underreamer assembly to continuously clean drilling debris from the underreamer assembly represents a significant improvement in the drilling art.

The foregoing description of the invention is intended to be illustrative rather than exhaustive. Those skilled in the art will appreciate that numerous changes in detail are possible without departing from the scope of the following claims.

I claim:

1. A pneumatic boring apparatus comprising:

a down-hole pneumatic bit assembly;

a first section of dual wall pipe connected to the down-hole pneumatic bit assembly;

a second section of dual wall pipe; and a coupler joining the first and second dual wall pipe sections, the coupler comprising a first member, a second member, surfaces in each of said first and second members which define first and second bores, and first and second pins disposed in said respective first and second bores.

2. A pneumatic boring apparatus according to claim 1 which further comprises surfaces defining at least one axial bore through the coupler which is in communication with the interconnected first and second dual wall pipe sections.

3. A pneumatic boring apparatus according to claim 1 wherein the first and second coupler members include respective engageable surfaces for transmitting torque between the first and second dual wall pipe sections.

4. A pneumatic boring apparatus according to claim 3 wherein the first and second coupler members' respective engageable surfaces comprise generally flat surfaces.

5. A pneumatic boring apparatus according to claim 3 wherein each of the first and second coupler members includes six engageable surfaces.

6. A pneumatic boring apparatus according to claim 1 wherein the down-hole pneumatic bit assembly comprises a pneumatic hammer.

7. A pneumatic boring apparatus according to claim 1 wherein the down-hole pneumatic bit assembly comprises an underreamer bit assembly.

* * * * *